United States Patent [19]

Hill

[11] 3,990,765

[45] Nov. 9, 1976

[54] CONNECTOR FOR TERMINATING SCREENED MULTICONDUCTOR CABLES

[75] Inventor: Frederick William Leslie Hill, Lechlade, England

[73] Assignee: Raychem Limited, London, England

[22] Filed: Apr. 30, 1975

[21] Appl. No.: 573,174

[30] Foreign Application Priority Data

May 3, 1974 United Kingdom ..... 19544/74

[52] U.S. Cl. ..... 339/177 R; 339/143 R; 339/DIG. 1

[51] Int. Cl.[2] ..... H01R 17/18

[58] Field of Search ..... 339/143 R, 177 R, 177 E, 339/DIG. 1; 174/78, 89

[56] References Cited

UNITED STATES PATENTS

| | | | |
|---|---|---|---|
| 3,280,246 | 10/1966 | Lawson | 174/78 |
| 3,320,355 | 5/1967 | Booker | 339/DIG. 1 |
| 3,740,839 | 6/1973 | Otte | 339/30 |
| 3,744,007 | 7/1973 | Horak | 339/177 E |

FOREIGN PATENTS OR APPLICATIONS

| | | | |
|---|---|---|---|
| 2,048,694 | 4/1972 | Germany | 339/143 R |

*Primary Examiner*—Roy Lake
*Assistant Examiner*—Mark S. Bicks
*Attorney, Agent, or Firm*—Lyon & Lyon

[57] ABSTRACT

Described herein are connectors for terminating screened multiconductor cables. The connectors comprise a longitudinally slotted tubular grounding member having resilient tines between which are positioned individual leads or screens of the multiconductor cable. Fastening means are provided around the tines which, upon tightening, cause the slotted portion of the tubular grounding member to contract so that the leads or screens are firmly gripped. The fastening means preferably comprises a heat-shrinkable metal band or ring of a memory metal and is advantageously further provided with a collet, band or ring positioned internally of said heat-shrinkable member. Also described are methods of utilizing said connector in the termination of multiconductor cables.

11 Claims, 5 Drawing Figures

CONNECTOR FOR TERMINATING SCREENED MULTICONDUCTOR CABLES

BACKGROUND OF THE INVENTION

This invention relates to the termination of cables, especially multiconductor cables.

The protection of electric wiring against the ingress of electrical interference is of special importance when high reliability electric systems of a complex nature have to function properly in an environment of high level electrical interference. The signal circuits in such systems are operated at low levels and must be adequately screened to prevent malfunctions caused by such interference.

In practical terms, the exclusion of interference from sensitive circuits entails surrounding the vulnerable areas with a conductive shield, usually connected to earth. Referring especially to cable harnessing, this means that there has to be employed some kind of braiding or flexible electrically conductive tubing with no openings in it and with a low electrical resistance in itself and in any connections which it contains. In practice, this may entail one or more braided screens and, taking a typical example, a multicore cable used in such a harness would comprise signal lines in the form of twisted pairs to reduce interference sensitivity by common mode rejection, each twisted pair being individually screened. The bundle of wires is then enclosed in an outer overall screen comprising one or more layers of braided wire protected by a flexible plastics outer jacket. The braids are conventionally made from copper, optionally plated with nickel, silver or tin.

Obviously, the termination of multicore cables screened in this way presents certain difficulties. For example, when the cables have to pass into adaptors, plugs and other connecting devices, not only do the individual conductors have to be properly connected to the respective device but also the individual screens and the outer screens, if present, must be properly grounded. The cables commonly comprise bundles and sub-bundles of conductors which may not be of uniform size and, until recently, the termination of such cables has necessitated the use of special tools and bulky termination devices. This has led to a high assembly cost.

An ideal termination device would meet the following requirements:

1. It would provide a means for individually terminating each of the inner screens in a way which avoided loops.
2. It would be easy to load without special tools.
3. It would be free of holes through which interference might leak.
4. It would be easily attached to a standard connector.
5. It would provide means for terminating the outer screen(s).
6. It would be relatively light and non-bulky.
7. It would be electrically sound but, at the same time re-openable for repair or modification purposes without damage to the screens so that the termination can be re-made without further cutting back of the cable.

In U.S. Pat. No. 3,465,092 there is described and claimed a termination assembly for bundles of electrical leads or screens which comprises a first cylindrical, externally threaded element having a plurality of spaced longitudinal slots and a second cylindrical driving ring in threaded engagement therewith. The driving ring rotatably carries a contact annulus which is provided with a plurality of contact sections which fit the slots of the first element. The individual leads or screens are positioned in the slots and the assembly is then screwed together tightly so that the leads or screens are firmly held in the slots by the contact sections of the annulus.

Whilst this assembly has many advantages in that it is relatively simple, non-bulky and does not require the use of special tools it does, however, have certain disadvantages. First of all, the final connection is formed within the second cylindrical element and so it is not possible to check visually that a proper connection has been made. Secondly, when a plurality of leads or screens are to be connected there are no means provided for holding one lead (or screen) in place whilst another is being loaded. Finally, there are no means provided for simply terminating an outer screen (or screens). The last disadvantage is especially important in high interference applications.

SUMMARY OF THE INVENTION

The present invention provides a method of terminating a plurality of electrical leads or screens wherein the individual leads or screens are inserted between the tines of a longitudinally slotted tubular grounding member and are held in position by resilient forces generated upon inserting them in said slots, and then fastening means are positioned around the tines and tightened to cause the slotted portion of the tubular grounding member to contract so that the leads or screens are firmly gripped between the tines.

The present invention also provides a device for terminating a plurality of electrical leads or screens which comprises a longitudinally slotted tubular grounding member, the tines of which are capable of exerting resilient forces upon leads or screens positioned between them, and fastening means adapted on tightening to cause the slotted portion of the tubular grounding member to contract.

The present invention also provides a longitudinally slotted tubular grounding member suitable for use in the above method, the tines of which are capable of exerting resilient forces upon leads or screens positioned in the slots between them, the slots being wider along a part of their length remote from the base of the tines to facilitate loading of the leads or screens.

It will be seen that, even in its simplest form the present invention provides means for terminating a plurality of leads or screens wherein by using the resilient forces generated by arcuately spaced longitudinal tines when the leads or screens are positioned between them, loading and assembly is facilitated in that there is no danger of one lead or screen becoming displaced whilst another is being loaded. Furthermore, by virtue of the positive resilient gripping action of the tines it is possible visually to check that the leads or screens are properly loaded before the fastening means is tightened to form the final secure connection. Any unoccupied slots between the tines can, if necessary be filled by "dummy" leads or screens or by causing the leads or screens already held in occupied slots to re-enter the grounding member by way of an unoccupied slot. Because of the final radial and peripheral contraction of the resilient slotted portion of the tubular grounding member upon tightening of the fastening means a disparity in the size or number of the leads or sceens in the individual slots can largely be compensated for. Similarly this contraction further helps to avoid the formation of holes for interference leakage.

It will also be appreciated that the word "tubular" is used herein in a broad sense and includes for example split tubes and tubes having non-circular or non-uniform cross-section, as well as L-, Y-, T- and X-shaped members.

A further important advantage of the present invention is that it readily allows simultaneous simple termination and grounding of an outer screen or screens. It is therefore especially applicable to the termination of screened multicore cables used in high interference level installations. In a typical termination, for example, after cutting back, the outer screen is telescoped back along the cable whilst the individual inner screens are firmly positioned (in place) in the slots of the tubular grounding member. The outer screen is then moved forwards again and is caused to cover the slotted portion of the grounding member, which may, if desired, be tapered longitudinally or otherwise shaped so as to facilitate positioning of the outer screen. (It may also be provided with an outer peripheral protuberance or similar member over which the outer screen is passed and which helps to prevent the outer screen from subsequently slipping off the grounding member). The fastening means is then positioned around the outer screen over at least part of the slotted portion of the grounding member. When it is then tightened, it not only causes contraction of the slotted portion, as described above, but also firmly grips the outer screen about the grounding member. Thus, in a very simple manner, the inner and outer screens are simultaneously grounded.

Accordingly, in an especially preferred form of the present invention there is provided a method of terminating a multiconductor cable which has an outer screen and in which the individual conductors or sub-bundles of individual conductors are also screened, which comprises inserting the freed ends of the screens of the individual conductors or sub-bundles of individual conductors between the tines of a longitudinally slotted tubular grounding members so that the screens are held in positioned by resilient forces generated upon inserting them in said slots, passing the outer screen at least partially around the slotted portion of the tubular grounding member, positioning fastening means around the outer screen over the slotted portion and then tightening the fastening means to cause the slotted portion of the tubular grounding member to contract so that the screens from the individual conductors or sub-bundles of individual conductors are firmly gripped between the tines and so that the outer screen is firmly gripped against the tubular grounding member.

The individual conductors may themselves be terminated in a conventional manner to a standard connector body assembly and the tubular grounding member is preferably provided with means, such as internal or external screw threading, for engagement with such a standard connector body assembly. In a preferred embodiment the tubular grounding member is provided with a loosely mounted threaded portion which facilitates the operation of screwing the grounding member onto the standard connector assembly.

The termination when made is preferably insulated and protected, for example by a heat-shrinkable plastics boot, and, for this purpose the tubular grounding member is preferably contoured to provide an annular groove or flange to receive a corresponding lip or groove on such a boot. The resilience between the times can be achieved in many ways but is preferably obtained by using the resilience of a thin flexible portion of the grounding member near the base of the tines. In practice, therefore, the grounding member is preferably made as an intergral part from a resilient metal such as beryllium copper or an aluminium alloy. However, it could alternatively be fabricated from two or more parts. For example plurality of non-resilient tines could be welded to a resilient base portion or could be resiliently mounted (e.g. by spring pivots) on a non-resilient base portion. Preferably, in all cases, the tines are given a slight inwards bias.

In principle, any form of suitable fastening means can be employed in the present invention, for example a hose-clip, such as a Jubilee clip, would be quite satisfactory. However, the tightening of such a clip might prove difficult in very cramped environments and it is generally preferred, therefore, to employ a fastening ring made from a "memory" metal (or a heat-recoverable metal) which can be applied in a cold form around the grounding member and which when warmed through the transition temperature of the memory metal will shrink radially and cause contraction of the grounding member.

Suitable memory metals and their properties are described, for example, in U.S. Pat. Nos. 3,558,369, 3,753,700 and 3,351,463 the disclosures of which are incorporated herein by reference. Basically, these memory metals are alloys which are capable, like certain plastics materials, of having the property of heat recoverability imparted to them by virtue of their different properties in their martensitic (low temperature) and austenitic (high temperature) states. Thus an article made from such a memory metal can be deformed whilst in the mratensitic state to a heat unstable configuration in which it will remain whilst kept in the martensitic state. When it is warmed through the transition temperature (which, in practice, is usually a small temperature range) to its austenitic state, however, it will recover towards its original form. As disclosed in British Pat. No. 1,327,442 some of this recovery can be made reversible by imparting further secondary or non-thermally recoverable deformation to the article and thus when a heat-shrunk fastening ring is once again cooled to its martensitic state a small degree of re-expansion may occur, which may be sufficient to remove the ring from the termination. Since the degree of re-expansion is generally rather small, however, it is preferred, in re-usable connectors, to employ the heat recoverable metal article in conjunction with a resilient connecting member.

Reference in this respect is made to U.S. Pat. No. 3,740,839, the disclosure of which is also incorporated herein by reference, which describes and claims a re-usable connector comprising a heat recoverable metal member (e.g. a band) in conjuction with a resilient connecting member (e.g. a longitudinally slotted cylindrical element positioned inside the band). When the temperature is above the transition temperature the recovery force of the recoverable metal band dominates and a connection is made on to an underlying object. When, on the other hand, the band is cooled to its weaker martensitic state, the resilient forces of the tines of the connecting member are dominant and the band is forced to expand, thus releasing any connection which has been made.

Such re-usable connectors may advantageously be used as the fastening means in the present invention. However, other forms of fastening means utilising heat recoverable metal members may also be advantageously used. For example a heat shrinkable metal band may be used in conjunction with a non-resilient connecting member such as a deformable split ring.

BRIEF DESCRIPTION OF THE DRAWINGS

The invention will now be described in more detail, by way of example only, with reference to the accompanying drawings, in which.

DESCRIPTION OF THE PREFERRED EMBODIMENTS

Figure 1:
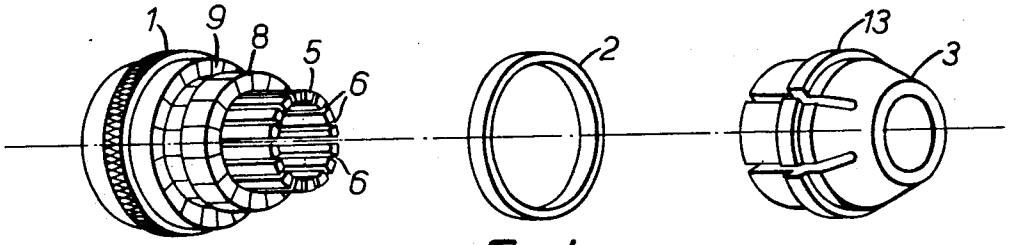
FIG. 1 represents an exploded view of a termination device in accordance with the present invention.

Referring now to FIG. 1, the device indicated comprises a tubular grounding member 1 and associated fastening means comprising a heat recoverable metal ring 2 and a resilient tined collet 3. As shown more clearly in FIG. 2, the grounding member 1 is screwed onto a standard connector 4.

The grounding member 1 has a plurality of tines 5, the slots 6 between the tines being wider at the end remote from the base of the tines to facilitate loading and narrower towards the base of the tines to ensure firm resilient positioning of the individual screens. The tines are generally thin and derive their resilience from a thin flexible base panel 7 which allows them radial and circumferential motion. However, they have thicker portions 8 near to their base which help to ensure proper grip of the individual screens and which also form an annular groove 9 with base panel 7, which can co-operate with the lip of heat shrinkable boot 10. The groove 9 also provides an easy means for causing individual screens to re-enter and block any unoccupied slots 6, as discussed above. The thicker portions 8 also provide a surface against which the outer screen and collet can abut and thus facilitate positioning of these members.

The grounding member 1 is also preferably provided with a loose inner ring 11 having a skirt 12. This fulfils three functions: it blocks up the slots 6 to prevent interference leakage; it prevents the inner screens from slipping right through the slots 6 during loading and it provides a non-rotating chamfered sealing ring to mate with the conventional rubber bung in the rear of the standard connector 4.

The heat shrinkable ring 2 is, for example, made from a nickel-titanium alloy and the resilient collet 3 is designed to co-operate with it to form a re-usable fastening means in accordance with the invention described in U.S. Pat. No. 3,740,839. The collet 3 has a peripheral ridge 13 which facilitates positioning and retention of the ring 2.

Figure 2:
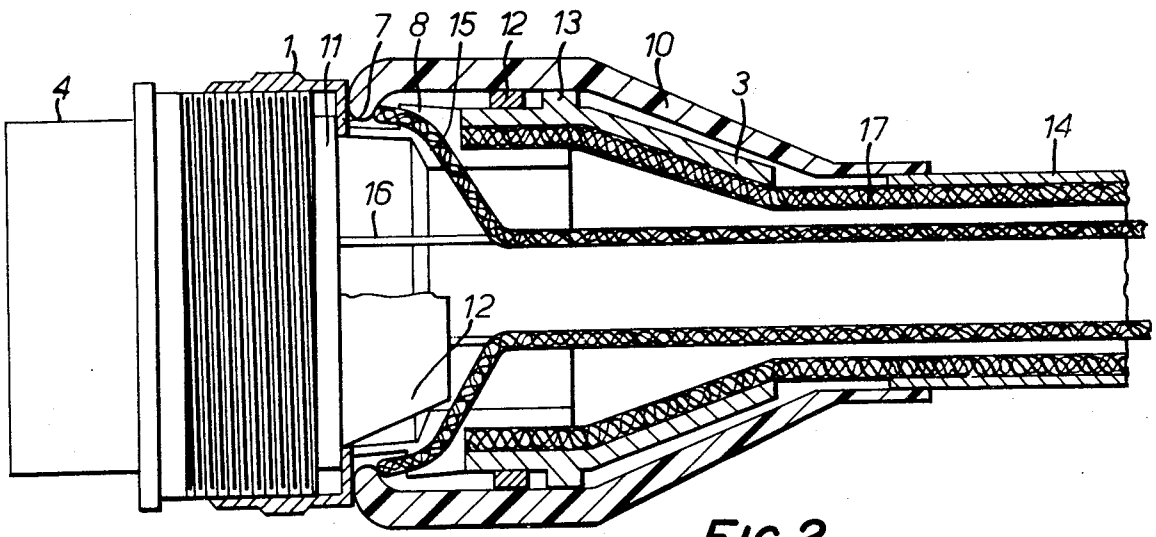
FIG. 2 is a cross-sectional view of a ground termination of a screened multicore cable using the device of FIG. 1.

Referring now especially to FIG. 2, the device is used as follows.

After preparing the cable ends and crimping on connector pins, the components of the termination device are threaded in turn on to the cable jacket 14. The heat shrinkable plastics boot 10 goes on first, followed by the collet 3 and ring 2 (with the ring 2 positioned over the collet 3) and, finally, the grounding member 1 containing the loose inner ring 11.

After inserting the connector pins into the connector body the grounding element 1 is screwed on to the back of the connector 4 trapping the loose inner ring 11. The tines 5 are springy and have an inward radial bias. The slots 6 between the tines are relatively wide along their lengths from the thicker portions 8 to their free ends to facilitate loading. One of the inner screens 15 (which has been separated from its conductor 16 by having the conductor pass through a hole in its side) is placed into one of the wide slots 6. The screens 15 may be flattened, if desired, to facilitate location in the slots 6. A suitable tool, such as a screwdriver point, is then introduced into the end of the slot 6 so as to spring the tines 5 apart allowing the screen 15 to be drawn between the thicker portions 8 of the tines. 5. On removing the screwdriver, the inward bias of the tines 5 grips the screen 15, firmly holding it in place while the remainder of the screens 15 are similarly installed in the other slots 6 by working round the body of the grounding member 1. Dealing with inner screens is the most delicate part of the operation of cable termination, and in this case it is carried out on the outside of the grounding member in an easily accessible position. One or two screens 15 can be positioned in each slot 6, but if there are less screens than slots, some of the screens 15 should be taken through the slot as described, and then into the groove 9 and back through an adjacent slot so that all slots contain at least one screen. Excess braid is then trimmed off around the outside of the thickened portion 8 or from inside the groove 9 and the assembly of the inner screens for termination is thus completed.

The outer cable screen 17 which has been telescoped back previously is now extended over the parallel portion of the tines 5 until it abuts the face provided by the thickened portions 8. The fastening means comprising the assembled ring 2 and resilient collet 3 is then cooled, e.g. by using liquid nitrogen. In this condition it is large enough to pass over the outer screen 17 until it also abuts the face of the thickened portions 8. On warming above the transition temperature, e.g. up to room temperature, the resilient collet 3 is compressed under the action of the heat recoverable metal ring 2 trapping the outer screen 17 between itself and the tines. This action squeezes the tines 5 towards the centre of the grounding member 1, thus tending to close the slots 6 containing the inner screens 15 in the area of thickened portions 8. A feature of the device is that the closing action of the slots 6 which trap the inner screens 15 is, to an extent, self-compensating so that, within limits, braids of differing thicknesses can be used. The heat shrinkable plastics boot 10 is then moved into position and recovered.

In most cases the termination device will be required to operate at temperature from −40° C upwards, may be as low as −75° C. Accordingly, it is essential that the transition temperature of the memory metal lies below the lowest operation temperature, to ensure that there is no chance of the ring 2 expanding and thus damaging the termination. If it is desired, however, to repair or modify the termination this can simply be done by destroying the plastics boot 10 and then cooling the ring 2, for example by spraying with liquid nitrogen, so that it expands under the resilient forces of collet 3 and can be removed from the outer screen 17. After repair or modification the termination can readily be remade employing only a new heat shrinkable plastics boot.

Figure 3:
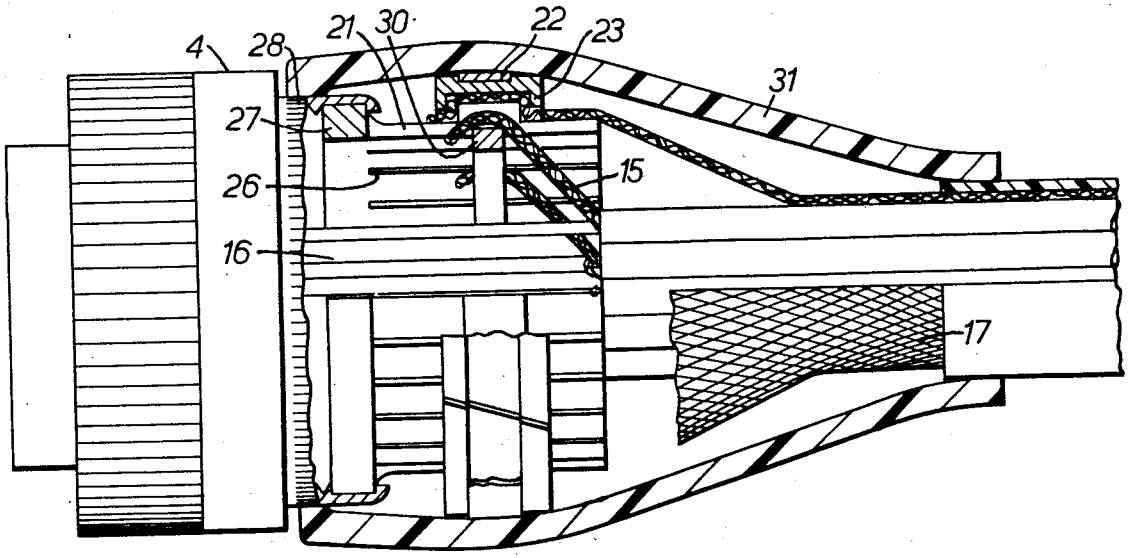
FIG. 3 is a view, partly in section, of a ground termination of a screened multicore cable using a second form of device in accordance with the present invention.
Figure 4:
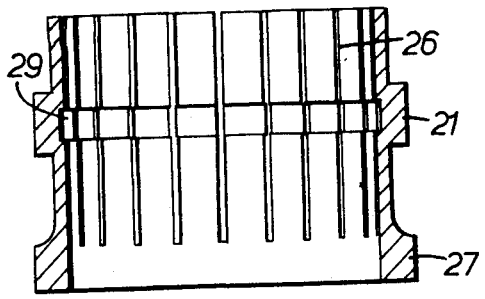
FIG. 4 is a cross-sectional view of the tubular grounding member used in the device of FIG. 3.
Figure 5:
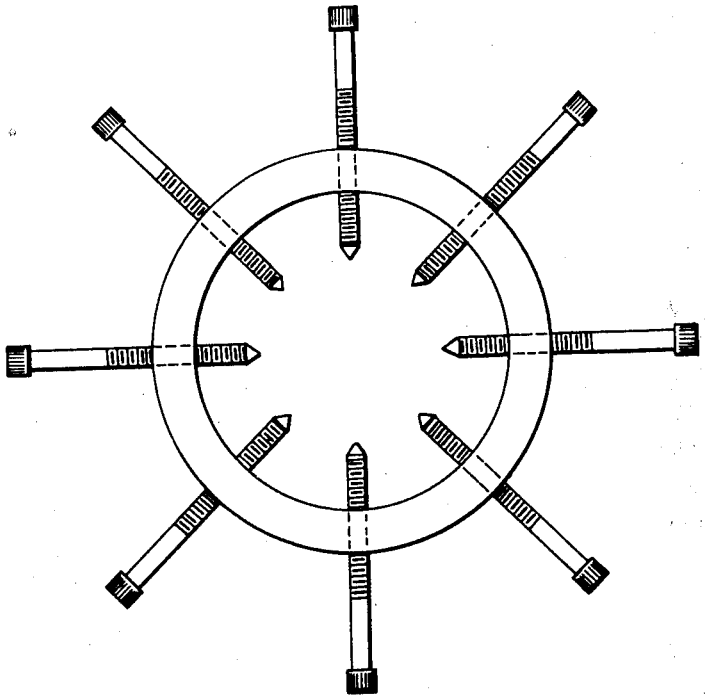
FIG. 5 shows a tightening device for use with the fastening means employed in the device of FIG. 3.

Referring now to FIGS. 3 to 5, the drive shown comprises a tubular grounding member 21 provided with fastening means consisting of a heat shrinkable metal band 22 and a non-resilient, deformable metal split ring member 23. The tubular grounding member 21 differs slightly from that used in the device of FIGS. 1 and 2 in that the slots 26 do not extend into its base portion 27. In addition it is provided with a separate, loosely attached screw threaded end portion 28 to facilitate connection to the standard backshell connector 4. One further modification is that the tubular grounding member 21 is provided midway along its length with an internal groove 29 within which is positioned a split ring 30. This ring functions in a manner similar to the ring 11 in the device shown in FIGS. 1 and 2 and also prevents the screens 15 from slipping right up to the base 27 during loading. The split ring 30 could, if desired, be provided with a skirt further to prevent interference leakage between any unfilled slots 16.

The fastening means comprises heat recoverable metal band 22 and non-resilient split ring 23. The ring 23 is provided with annular grooves on its internal and external surfaces for proper location with the grounding member 21 and the band 22 respectively. During installation the split ring 23 may be tightly positioned about the grounding member 21 (after loading of the screens 15 and 17) by using a tightening device such as the "ship's wheel" shown in FIG. 5. The heat recoverable metal band 22 may then be allowed to shrink into position to make the final connection.

As shown the termination is provided with a heat shrinkable plastics boot 31. However, it will be appreciated that the exact nature of any outer installation will vary according to the application concerned. For example, if two backshells 4 were to be interconnected a heat shrinkable plastics sleeve could be shrunk about the connection between the metal rings 23 and a separate boot could be placed in position on each of the connectors between the other side of said ring 23 and the outer insulation of the cable. In this way the bulk of the final connection would be kept as low as desirable.

While embodiments and applications of this invention have been shown and described, it will be apparent to those skilled in the art that many more modifications are possible without departing from the inventive concepts herein described.

I claim:

1. A device for terminating a plurality of electrical leads or screens which comprises:

a. a longitudinally slotted tubular grounding member having tines separated by said slots, the slots between adjacent tines providing means for receiving said leads or screens, said tines being circumferentially resilient when displaced by the insertion of leads or screens in said slot, and b. fastening means for moving the tines to contract the space defined by said slots.

2. A device according to claim 1, wherein said tines have a base and the slots between the tines are wider along a part of their length remote from the base of the tines.

3. A device according to claim 1, wherein the tines of the tubular grounding member are provided along part of their length with an outer protuberance.

4. A device according to claim 1, wherein the tubular grounding member is provided with means for engagement with a standard connector body assembly.

5. A device according to claim 4, wherein said engagement means comprise a threaded portion which is loosely mounted on the body of the tubular grounding member.

6. A device according to claim 1, wherein the fastening means comprises a heat-shrinkable ring made from a memory metal.

7. A device according to claim 6 wherein the fastening means further comprises a metal band positioned internally of said ring of memory metal.

8. A device according to claim 7, wherein said metal band is resilient.

9. A device according to claim 7, wherein said metal band is a split non-resilient band.

10. A device according to claim 1, wherein said tubular grounding member is also provided with a loose inner member which blocks the unoccupied portions of the slots to prevent interference leakage.

11. A device for terminating a plurality of electrical leads or screens which comprises a longitudinally slotted tubular grounding member having tines separated by said slots, the slots between adjacent tines providing means for receiving said leads or screens, said tines being circumferentially resilient when displaced by the insertion of leads or screens in said slots, said tines having a base and the slots being wider along a part of their length remote from the base of the tines to facilitate loading of the leads or screens.

* * * * *